US006821698B2

(12) United States Patent
Sawada et al.

(10) Patent No.: US 6,821,698 B2
(45) Date of Patent: Nov. 23, 2004

(54) TONER FOR DEVELOPING ELECTROSTATIC LATENT IMAGE, TONER CARTRIDGE, IMAGE FORMING METHOD, PROCESS CARTRIDGE AND IMAGE FORMING APPARATUS

(75) Inventors: Toyoshi Sawada, Odawara (JP); Masanori Suzuki, Shizuoka-ken (JP); Yohichiroh Watanabe, Fuji (JP); Keiko Shiraishi, Susono (JP); Takuya Saito, Numazu (JP)

(73) Assignee: Ricoh Company, LTD, Tokyo (JP)

( * ) Notice: Subject to any disclaimer, the term of this patent is extended or adjusted under 35 U.S.C. 154(b) by 57 days.

(21) Appl. No.: 10/251,855

(22) Filed: Sep. 23, 2002

(65) Prior Publication Data

US 2003/0129518 A1 Jul. 10, 2003

(30) Foreign Application Priority Data

Sep. 21, 2001 (JP) ..... 2001-288776

(51) Int. Cl.[7] ..... G03G 9/087

(52) U.S. Cl. ..... 430/108.4; 430/109.4; 430/111.4

(58) Field of Search ..... 430/108.4, 109.4, 430/111.4

(56) References Cited

U.S. PATENT DOCUMENTS

| | | | | |
|---|---|---|---|---|
| 6,074,795 | A | 6/2000 | Watanabe et al. | |
| 6,103,441 | A | 8/2000 | Tomita et al. | |
| 6,168,894 | B1 | 1/2001 | Aoki et al. | |
| 6,180,298 | B1 | 1/2001 | Kuroda et al. | |
| 6,335,137 | B1 | 1/2002 | Suzuki et al. | |
| 6,363,229 | B1 | 3/2002 | Shiraishi et al. | |
| 6,383,705 | B2 * | 5/2002 | Aoki et al. | 430/109.4 |
| 2003/0039910 | A1 * | 2/2003 | Shirai et al. | 430/109.4 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A toner for developing electrostatic latent images, including a colorant, a releasing agent and a binder resin, wherein the binder resin comprises a first, crystalline polyester resin, and a second, amorphous polyester resin having a softening point higher than that of the first polyester resin and being incompatible with the first polyester resin.

28 Claims, 2 Drawing Sheets

TONER FOR DEVELOPING ELECTROSTATIC LATENT IMAGE, TONER CARTRIDGE, IMAGE FORMING METHOD, PROCESS CARTRIDGE AND IMAGE FORMING APPARATUS

BACKGROUND OF THE INVENTION

1. Field of the Invention

This invention relates to a toner for developing an electrostatic latent image formed by electrophotography, electrostatic recording or electrostatic printing and to a toner cartridge containing the toner. The present invention is also directed to an image forming method, a process cartridge and image forming apparatus using the toner.

2. Discussion of the Background

Various electrophotographic image forming methods have been disclosed in, for example, U.S. Pat. No. 2,297,691, Japanese Patent Publications Nos. 49-23910 and 43-24748. The methods typically include the following steps:

(1) the surface of an image bearable member such as a photoconductor is charged (charging process);
(2) the image bearable member is exposed to light to form an electrostatic latent image thereon (latent image forming process);
(3) the latent image is developed with an electrophotographic toner to form a toner image on the image bearable member (developing process);
(4) the toner image is transferred onto a receiving material (transferring process); and
(5) the toner image on the receiving material is fixed by application of heat, pressure, solvent vapor, or combination thereof to prepare a copy image (fixing process).

The method for developing electrostatic latent images is broadly classified into the following methods:

(1) a wet developing method using a liquid developer including a fine color pigment or dye dispersed in a liquid; and
(2) a dry developing method such as a cascade method, a magnetic brush method and a powder cloud method, which uses a developer (toner) including a colorant such as carbon black dispersed in a binder resin. Recently the dry developing methods are widely used.

As the method for fixing toner images, methods using a heat roller are widely used because of good energy efficiency thereof. Recently, there is an increasing demand for an image fixation method which requires as small a heat energy as possible to meet with high speed reproduction and saving of energy. In the DSM (Demand-side Management) program in 1999 of IEA (International Energy Agency), requirements for next generation image forming apparatuses are described. It is described in the requirements that the warming-up time should not be greater than 10 seconds and the power consumption in a waiting state, which changes depending on the copying speed, should not be greater than 10–30 watts in a copying machine having a copy speed not less than 30 cpm (copies per minutes). In order to meet these requirements, the power consumption of copying machines must be dramatically reduced.

In attempting to meet the above requirements, fixing devices using a fixing element such as a heat roller, which has a low thermal capacity and which has a quick temperature rising time, have been researched. However, the devices do not bring about the desirable effects.

In order to satisfy the requirements for minimizing the energy consumption of image forming apparatus while minimizing the warming-up time, it is essential to develop a toner which can be fixed at a low temperature.

The use of a polyester resin, which has better low temperature fixation property and better heat resistant preservability as compared with the conventional styrene-acrylate copolymer, as a binder resin of a toner has been proposed (Japanese Laid Open Patent Publications Nos. 60-90344, 64-15755, 2-82267, 3-229264, 3-41470 and 11-305486). Further, in an attempt to improve low temperature fixation properties, Japanese Laid Open Patent Publication No. 62-63940 proposes the use of a non-olefinic crystalline polymer and Japanese Patent No. 2931899 and Japanese Laid Open Patent Publication No. 2001-222138 propose the use of a crystalline polyester.

The above toners, however, are not fully satisfactory to meet the requirements of the DSM program.

SUMMARY OF THE INVENTION

There is provided in accordance with the present invention a toner for developing electrostatic latent images, comprising a colorant, a releasing agent and a binder resin, wherein said binder resin comprises a first, crystalline polyester resin, and a second, amorphous polyester resin having a softening point higher than that of said first polyester resin and being incompatible with said first polyester resin.

In another aspect, the present invention provides a toner cartridge containing the above toner.

The present invention also provides an image forming method, comprising developing an electrostatic latent image on an latent image-bearing member with the above toner.

The present invention further provides a process cartridge freely detachable from an image forming apparatus, comprising a photoconductor, and at least one means selected from the group consisting of a charger, image exposure means, developing means including the above toner, image transfer means, and cleaning means.

The present invention further provides an image forming apparatus comprising a developing unit for developing an electrostatic latent image on an latent image-bearing member with the above-described toner.

In order to improve low temperature fixation properties of a toner, it is necessary to control the thermal characteristics of the binder resin thereof. However, when the glass transition point (Tg) of the binder resin is excessively low, the heat resistant preservability of the toner is adversely affected. When the softening point of the binder resin is lowered by reducing the molecular weight thereof, a problem of hot offset (adhesion of the toner to the heat roll) is caused. Thus, it is difficult to obtain a toner having both excellent low temperature fixation efficiency and excellent offset resistance by controlling the thermal characteristics of the binder resin.

It has been found that the low temperature fixation properties can be improved by using a crystalline polyester resin. When heated above its grass transition point, such a polyester resin can cause a phase change from solid to melt at a relatively low temperature and the melt viscosity thereof quickly decreases. As a consequence, fixation to a transfer sheet such as paper proceeds efficiently. Since the grass transition point and the softening point of the crystalline polyester resin are low, the toner containing same has good low temperature efficiency. It has been also found that when such a crystalline polyester is used in conjunction with another, non-crystalline polyester resin having a higher softening point than the crystalline polyester resin, the two polyester resins form discrete domains such as sea-islands structure, so that the properties inherent to the two types of the polyesters can be suitably exhibited. Thus, the hot offset resistance of the resulting toner is improved because of the elasticity attributed to the non-crystalline polyester resin (second polyester resin) while retaining the desired low temperature fixation efficiency attributed to the crystalline polyester resin (first polyester resin).

It is an object of the present invention to provide a toner for developing an electrostatic latent image, which has excellent low temperature fixation efficiency and good offset preventing properties.

Another object of the present invention is to provide a toner of the above-mentioned type which has good preservability and which gives high grade toner images with excellent reproducibility.

It is a further object of the present invention to provide a method which permits the formation of a toner image on an image receiving sheet at a low fixing temperature and in a wide fixing temperature range without causing a hot offset problem.

BRIEF DESCRIPTION OF THE DRAWING

Other objects, features and advantages of the present invention will become apparent from the detailed description of the preferred embodiments which follows, when considered in light of the accompanying drawings, in which.

DETAILED DESCRIPTION OF THE PREFERRED EMBODIMENTS OF THE INVENTION

Figure 1:
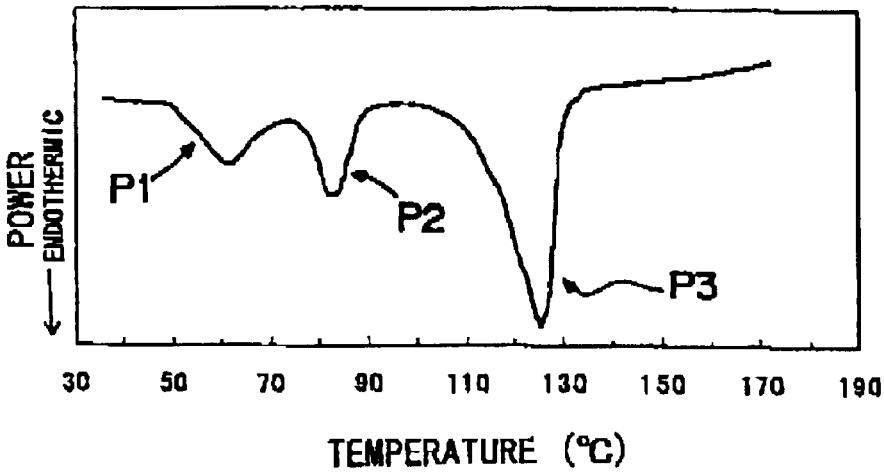
FIG. 1 is a DSC curve of a toner according to the present invention containing a binder resin which forms discrete domains.

A toner according to the present invention includes a colorant, a releasing agent and a binder resin. The binder resin comprises a first, crystalline polyester resin which preferably has a softening point in the range of 80 to 130° C. and a glass transition point in the range of 90 to 130° C. The first polyester resin preferably has a recurring unit represented by the following formula (I);

$$—O—CO—R—CO—O—(CH_2)_n— \quad (I)$$

wherein R represents a divalent hydrocarbyl group having 2–35 carbon atoms, preferably 2–20 carbon atoms, more preferably 2–4 carbon atoms, and n is an integer of 2 to 20, preferably 2–6. The binder resin also contains a second, amorphous polyester resin having a softening point higher than that of the first polyester resin and being incompatible with the first polyester resin. The amount of the recurring unit of the formula (I) in the first polyester resin is preferably at least 60 mole %, more preferably at least 80 mole %, most preferably 90 to 95 mole %.

The divalent hydrocarbyl group R of the formula (1) may be an acyclic straight or branched alkenylene or alkylene group. The hydrocarbyl group R is preferably, a divalent unsaturated aliphatic group having at least one carbon—carbon double bond, more preferably a divalent, straight chain, unsaturated aliphatic group. Examples of the divalent unsaturated aliphatic group represented by R in the formula (I) include $—CR^1{=}CR^2—$ wherein $R^1$ and $R^2$ independently represent a hydrogen atom or a hydrocarbyl group. One specific example of the group R is —CH=CH— (vinylene) derived from maleic acid or fumaric acid. The divalent unsaturated aliphatic group R may also be $—CH{=}CHCH_2—$ derived from 1,3-n-propenedicarboxylic acid and $—CH{=}CHCH_2CH_2—$ and $—CH_2CH{=}CHCH_2—$ derived from 1,4-n-butenedicarboxylic acid.

Examples of the group $—(CH_2)_n—$ in the formula (I) include ethylene, propylene, butylene and hexylene derived from ethylene glycol, 1,3-propylene glycol, 1,4-butanediol and 1,6-hexanediol, respectively.

The first polyester resin may be obtained by polycondensation of (a) a polycarboxylic acid material including at least one unsaturated or at least one saturated aliphatic dicarboxylic acid (the terms "polycarboxylic acid" and "dicarboxylic acid" as used herein are intended to include their homologues such as acid anhydrides, alkyl(C1 to C4) esters and acid halides) with (b) a polyhydric alcohol material including at least one aliphatic diol.

Examples of the unsaturated aliphatic dicarboxylic acid included in the above-mentioned polycarboxylic acid material (a) include maleic acid, fumaric acid, 1,3-n-propenedicarboxylic acid and 1,4-n-butenedicarboxylic acid. Maleic acid and fumaric acid are especially preferably used. The unsaturated aliphatic dicarboxylic acid may be used in conjunction with one or more additional polycarboxylic acids such as unsaturated aliphatic dicarboxylic acids having one or more side chains, saturated aliphatic dicarboxylic acids, saturated aliphatic tricarboxylic acids, aromatic dicarboxylic acids and aromatic tricarboxylic acids. The amount of these additional polycarboxylic acids should be such that the resulting polyester is crystalline and is generally no more than 40 mole %, preferably no more than 20 mole %, more preferably no more than 10 mole %, based on the total mole of the polycarboxylic acid material.

Specific examples of the additional polycarboxylic acid include dicarboxylic acids such as malonic acid, succinic acid, glutaric acid, adipic acid, pimelic acid, suberic acid, azelaic acid, sebacic acid, phthalic acid, isophthalic acid and terephthalic acid; and tri-carboxylic acid such as trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane; and tetracarboxylic acid such as pyromellitic acid and 1,2,7,8-octanetetracarboxylic acid. Above all, succinic acid and trimellitic anhydride may be suitably used.

Examples of the saturated aliphatic dicarboxylic acid included in the above-mentioned polycarboxylic acid material (a) include oxalic acid, malonic acid, succinic acid, glutaric acid, adipic acid, pimelic acid, suberic acid, azelaic acid, sebacic acid, undecane dicarboxylic acid, dodecanoic acid, tridecane dicarboxylic acid, tetradecane dicarboxylic acid, pentadecane dicarboxylic acid, hexadecane dicarboxylic acid, heptadecane dicarboxylic acid, octadecane dicarboxylic acid, nonadecane dicarboxylic acid, eicosane dicarboxylic acid, heneicosane dicarboxylic acid, docosane dicarboxylic acid n-dodecyl succinic acid, n-dodecenyl succinic acid, iso dodecyl succinic acid, iso dodecenyl succinic acid, n-octyl succinic acid, n-oxotenyl succinic acid.

Examples of the aliphatic diol included in the above-mentioned polyhydric alcohol material (b) include ethylene glycol, 1,3-propylene glycol, 1,4-butanediol and 1,6-hexanediol. Particularly suitably used are 1,4-butanediol and 1,6-hexanediol. The aliphatic diol may be used in conjunction with one or more additional polyhydric alcohols such as aliphatic dihydric alcohols having side chains, cyclic dihydric alcohols and trihydric alcohols. The amount of such additional polyhydric alcohol should be such that the resulting polyester is crystalline and is generally no more than 40 mole %, preferably no more than 20 mole %, more preferably no more than 10 mole %, based on the total mole of the polyhydric alcohol material. Specific examples of the additional polyhydric alcohol include 1,4-bis(hydroxymethyl) cyclohexane, polyethylene glycol, ethylene oxide adduct of bisphenol A, propylene oxide adduct of bisphenol A and glycerin.

It is desired that the first polyester resin have a relatively small average molecular weight and have a relatively sharp molecular weight distribution for reasons of improved low temperature fixation efficiency. Thus, it is preferred that the first polyester resin have o-dichlorobenzene solubles having such a molecular weight characteristics according to gel permeation chromatography that the weight average molecular weight Mw ranges from 5,500 to 6,500, the number average molecular weight Mn ranges from 1,300 to 1,500 and the ratio (Mw/Mn) of the weight average molecular weight Mw to the number average molecular weight Mn ranges from 2 to 5.

Further, the o-dichlorobenzene solubles of the first polyester resin preferably have such a molecular weight distribution according to gel permeation chromatography (amount (% by weight) in ordinate vs. molecular weight in abscissa) that a main peak is present in a molecular weight region of $10^{3.5}$ to $10^4$ and that the main peak has a half value width of $10^{1.5}$ or less. Because of a low molecular weight and a sharp molecular weight distribution, the crystalline polyester resin causes a rapid decrease in melt viscosity when heated above the glass transition point thereof and permits low temperature fixation.

The gel permeation chromatography herein is performed as follows. A column is stabilized within a heat chamber set at 145° C. As an eluate, o-chlorobenzene containing 0.3% of BHT is passed at a rate of 1 ml per minute. An o-chlorobenzene solution containing 0.3% by weight of the sample resin is injected in an amount of 50 to 200 $\mu$l into a column. Measuring device is 150 CV manufactured by Waters Inc. and the column is Shodex AT-G+AT-806MS (two columns are used). The molecular weight of the sample is calculated from a calibration curve showing the relationship between the logarithm of the molecular weight and the retention time obtained using a monodispersion polystyrene standard sample. As the monodispersion polystyrene standard sample, at least 10 different polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ made by Toso Co., Ltd. or Pressure Chemical Co. are used. As a detection device, a refraction index (RI) detector is used.

It is preferred that the first polyester resin have a glass transition point (Tg) in the range of 65 to 140° C. and a softening point in the range of 65 to 140° C. in order to obtain improved heat resisting preservability and resistance to hot offset. The Tg of the first polyester resin is preferably 90 to 135° C. The softening point of the first polyester resin is preferably 80 to 125° C.

The term "softening point" as used herein is intended to refer to $F_{1/2}$ temperature measured using a commercially available flow tester of capillary type, "CFT-500" (Trademark), made by Shimadzu Corporation. A sample of the resin (1 $cm^3$) is placed in a cylinder of the tester provided with a small orifice with a diameter of 1 mm. The temperature of the sample is increased at a rate of 3° C./min while applying a pressure of 10 $kg/cm^2$ to the resin sample to permit the resin sample to flow out through orifice. The height of the sample resin in the cylinder, which decreases as the resin flows through the orifice, is plotted against the temperature. The temperature at which the height of the resin sample in the cylinder has decreased to ½ of the original height (½ of the height from the flow-out initiation point to the flow-out completion point) represents the softening point ($F_{1/2}$ temperature) of the sample resin.

The glass transition point herein is measured using Rigaku THERMOFLEX TG8110 manufactured by Rigaku Denki Co., Ltd. at a heating rate of 10° C. per minute.

It is desired that the first polyester resin show an X-ray diffraction pattern in which at least one peak is present in a region of 2θ of 20 to 25° for reasons of improved low temperature fixation efficiency. More preferably, the first polyester resin shows an X-ray diffraction pattern in which peaks are present in at least one of the four regions of, more preferably at least in each of the four regions of 2θ of 19–20°, 21–22°, 23–25° and 29–31° for reasons of improved low temperature fixation efficiency.

The powder X-ray diffraction analysis herein is made using a device (model RINT1100 manufactured by Rigaku Denki Co., Ltd.) equipped with a wide angle goniometer at X-ray tube voltage and current of 50 kV and 30 mA, respectively.

For reasons of good affinity between the binder resin of the toner and the paper on which a toner image is to be fixed while maintaining desired resistance to hot offset, the first polyester resin preferably has an acid value of 20 to 45 mg KOH/g, more preferably at least 25 to 40 mg KOH/g. For reasons of low temperature fixation efficiency and good charging efficiency, the hydroxyl value of the first polyester resin is preferably 5 to 50 mg KOH/g, more preferably 10 to 45 mg KOH/g.

The acid value and hydroxyl value herein are measured in accordance with Japanese Industrial Standards JIS K0070. If necessary, dioxane, tetrahydrofuran or o-chlorobenzene is used as a solvent.

It is essential that the second polyester resin to be used in conjunction with the first polyester resin as the binder resin of the toner according to the present invention should have a softening point ($F_{1/2}$ temperature) higher, preferably by 20 to 60° C., than that of the first polyester resin.

For reasons of satisfactory hot offset resistance, the second polyester resin preferably has a softening point of at least 120° C., more preferably at least 130° C. From the standpoint of energy saving at the time of toner manufacture, especially thermal energy required during kneading and electric energy required during kneading and pulverization, the softening point of the second polyester resin is preferably not higher than 160° C. more preferably not higher than 150° C.

The second polyester resin preferably has a glass transition point of 40 to 70° C., more preferably 45 to 65° C. for reasons of satisfactory heat resistant preservability and low temperature fixation efficiency.

It is desired that the second polyester resin have tetrahydrofuran (THF) solubles having such a molecular weight characteristics according to gel permeation chromatography that the weight average molecular weight Mw ranges from 3,000 to 100,000, more preferably 6,000 to 80,000, the number average molecular weight Mn ranges from 1,500 to 4,000, more preferably 1,800 to 4,000, and the ratio (Mw/

Mn) of the weight average molecular weight Mw to the number average molecular weight Mn ranges from 2 to 50, more preferably 4 to 40.

Any polyester resins may be used as the second polyester resin as long as it is amorphous (non-crystalline) in nature and is incompatible with the first polyester resin. The second polyester resin preferably contains at least 60 mole % of an ester unit having the formula (II) shown below in the main molecular chain thereof:

$$—O—CO—R^3—CO—O—R^4— \quad (II)$$

wherein $R^3$ and $R^4$ independently represent a divalent organic group.

The divalent organic group $R^3$ may be an aliphatic, alicyclic or aromatic group. The divalent aliphatic group may be an alkylene having 2 to 20, preferably 2 to 14 carbon atoms. The divalent alicyclic group may be a cycloalkylene group having 4 to 12, preferably 6 to 8 carbon atoms. The divalent aromatic group may be arylene group having 6 to 14, preferably 6 to 12 carbon atoms or an arylenedialkylene group having 8 to 12 carbon atoms.

The organic group $R^4$ may be an aliphatic, alicyclic or aromatic group. The divalent aliphatic group may be an alkylene having 2 to 14, preferably 2 to 12 carbon atoms. The divalent alicyclic group may be a cycloalkylene group having 5 to 14, preferably 6 to 8 carbon atoms. The divalent aromatic group may be arylene group having 6 to 14, preferably 6 to 12 carbon atoms or an arylenedialkylene group having 8 to 18 carbon atoms, preferably 8–15 carbon atoms. Especially preferred divalent organic group $R^4$ is represented by the following formula (III).

$$—(OR^7)_qO\text{-}Ph\text{-}R^6\text{-}Ph\text{-}O(R^8O)_p— \quad (I)$$

wherein Ph represents a phenylene group, $R^6$ represents an alkylene group having 1 to 6 carbon atoms, $R^7$ and $R^8$ independently represent an alkylene group having 2 to 4 carbon atoms, and p and q are each an integer of 1 to 16, preferably 2 to 14. The divalent group of the formula (III) is a residue of an alkylene oxide adduct of a bisphenol compound.

The second polyester resins may be obtained by polycondensation of a polyol and a polyacid (or its reactive homologue such as an acid anhydride, a lower alkyl (C1 to C4) ester or an acid halide). The polyol may be a diol or a mixture of a diol with a tri- or more polyhydric alcohol. As the diol to be used for the preparation of the polyester, any diol employed conventionally for the preparation of polyester resins can be employed. Preferred examples include alkylene glycols having 2 to 12 carbon atoms, such as ethylene glycol, 1,2-propylene glycol, 1,3-propylene glycol, 1,4-butane diol, neopentyl glycol, 1,4-butene diol, 1,5-pentane diol, and 1,6-hexane diol; alkylene ether glycols, such as diethylene glycol, triethylene glycol, dipropylene glycol, polyethylene glycol, polypropylene glycol, and polytetramethylene glycol; alicyclic diols having 6 to 30 carbon atoms, such as 1,4-cyclohexane dimethanol and hydrogenated bisphenol A; bisphenols, such as bisphenol A, bisphenol F and bispbenol S; adducts of the above-mentioned bisphenol with 2 to 8 moles of an alkylene oxide, such as ethylene oxide, propylene oxide, or butylene oxide.

Examples of the polyol having three or more hydroxyl groups include polyhydric aliphatic alcohols having 3 to 20 carbon atoms, such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylolethane, and trimethylolpropane. The polyol having three or more hydroxyl groups is used in an amount of no more than 20 mole %, preferably no more than 10 mole %, based on a total amount of the polyol having 2 or more hydroxyl groups.

The polyacid may be a dicarboxylic acid or a mixture of a dicarboxylic acid with a tri- or more polybasic carboxylic acid. As the dicarboxylic acid to be used for the preparation of the base polyester, any dicarboxylic acid conventionally used for the preparation of a polyester resin can be employed. Preferred examples of dicarboxylic acids include maleic acid, fumaric acid, succinic acid, adipic acid, sebacic acid, malonic acid, azelaic acid, mesaconic acid, citraconic acid, glutaconic acid, cyclohexanedicarboxylic acid, phthalic acid, isophthalic acid, terephthalic acid, toluenedicarboxylic acid, naphthalenedicarboxylic acid, lower alkyl esters thereof, and anhydrides thereof. These dicarboxylic acids may have one or more saturated or unsaturated hydrocarbyl groups having 3–22 carbon atoms.

Specific examples of the polycarboxylic acid having three or more carboxyl groups include 1,2,4-benzenetricarboxylic acid, 1,2,5-benzenetricarboxylic acid, 2,5-7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Enbol trimer acid, linoleic acid dimer, anhydrides thereof and lower alkyl esters thereof. The polyacid having three or more carboxyl groups is used in an amount of no more than 30 mole %, preferably no more than 20 mole %, based on a total amount of the polyacid having 2 or more carboxyl groups.

Above all, the use of a polyester resin obtained by polycondensation of a polycarboxylic acid material including at least one dicarboxylic acid selected from fumaric acid, terephthalic acid, dodecenylsuccinic anhydride and trimellitic anhydride with a polyol material including at least one alcohol selected from a propylene oxide adduct of bisphenol A and an ethylene oxide adduct of bisphenol A is particularly preferably used as the second polyester resin.

It is also preferred that the second polyester resin contain chloroform-insolubles (gel) in an amount of 2–40% by weight, more preferably 5 to 30% by weight, for reasons of good hot offset resistance. The second polyester resin preferably contain an aromatic group-containing polycarboxylic acid component and/or an aromatic group-containing polyol component in an amount of 30 to 100 mole %, more preferably 50 to 100 mole %, most preferably 60 to 100 mole %, based on the total acid and alcohol components constituting the ester linkages of the second polyester resin.

For reasons of good affinity between the binder-resin of the toner and the paper on which a toner image is to be fixed while maintaining desired resistance to hot offset, the second polyester resin preferably has an acid value of 20 to 45 mg KOH/g, more preferably at least 25 to 40 mg KOH/g. For reasons of low temperature fixation efficiency and good charging efficiency, the hydroxyl value of the second polyester resin is preferably 5 to 50 mg KOH/g, more preferably 10 to 45 mg KOH/g.

In addition to the first and second polyester resins, the binder resin of the toner may contain one or more resins. Examples of such additional resin include styrene resins (i.e., homopolymers and copolymers of styrene and its homogogues) such as polystyrene, polychlorostyrene, poly-α-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers (e.g., styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (e.g., styrene-methyl methacrylate copolymers, styrene-ethyl methacrylate copolymers, styrene-butyl methacrylate copolymers, and styrene-phenyl methacrylate copolymers), styrene-methyl α-chloroacrylate copolymers, styrene-acrylonitrile-acrylate copolymers; vinyl chloride resins, rosin-modified maleic acid resins, phenolic resins, epoxy resins, polyethylene resins, polypropylene resins, ionomer resins, polyurethane resins, silicone resins, ketone resins, ethylene-ethyl acrylate copolymers, xylene resins, polyvinyl butyral resins, petroleum resins and hydrogenated petroleum resins. Suitable manufacturing methods of these additional resins include the known methods which are mass polymerization, solution polymerization, emulsion polymerization, suspension polymerization and the like. The additional resin preferably has a glass transition temperature Tg of 55° C. or more, more preferably 60° C. or more, for reasons of the heat resisting preservability of the toner.

The total amount of the first and second polyester resins in the binder resin is generally 50 to 100% by weight, preferably 70 to 100% by weight. The amount of the first polyester resin in the binder resin is preferably 1 to 50% by weight, more preferably 2 to 30% by weight. The weight ratio of the first polyester resin to the second polyester resin is preferably 1/100 to 50/100, more preferably 5/100 to 30/100.

The toner according to the present invention contains a colorant, such as a dye or a pigment, for a black toner or a full color toner in addition to the binder resin. Specific examples of the pigments and dyes include carbon black, lamp black, iron black, Aniline Blue, Phthalocyanine Blue, Phthalocyanine Green, Hansa Yellow G, Rhodamine 6C Lake, chalco oil blue, Chrome Yellow, Quinacridone Red, Benzidine Yellow, Rose Bengale, triaryl methane and the like. These pigments and dyes are used alone or in combination. The toner of the present invention may be a black toner or a color toner. The amount of the colorant in the toner is generally from 1 to 30% by weight, preferably from 3 to 20% by weight of the binder resin included in the toner.

The toner according to the present invention may contain one or more customarily employed additives such as a releasing agent, a charge controlling agent and a fluidity improving agent.

Any known releasing agent may be suitably used for the purpose of the present invention. Among the known releasing agents, the use of a free fatty acid-removed carnauba wax, a montan wax, an oxidized rice wax and a mixture thereof is preferred. The carnauba wax is preferably a microcrystalline carnauba wax. In addition, the use of a carnauba wax having an acid value of not greater than 5 mgKOH/g and providing a particle diameter of not greater than 1 μm when dispersed in the toner is preferable. The Montan wax is preferably prepared by refining minerals and is preferably in the form of microcrystal. The use of a Montan wax having an acid value of from 5 to 14 mgKOH/g is preferred. The oxidized rice waxe may be prepared by oxidizing a rice bran wax with air. The acid value of the oxidized wax is preferably from 10 to 30 mgKOH/g. In addition, solid silicone varnishes, higher fatty acids, higher alcohols, montan ester waxes, low molecular weight polypropylene waxes and the like known releasing agents can also be used alone or in combination as the releasing agent. The releasing agent preferably has a glass transition point (Tg) of 70 to 90° C. for reasons of satisfactory heat resistant preservability of the toner and resistance to hot offset. The releasing agent is used in an amount of from 1 to 20% by weight, preferably from 3 to 10% by weight, based on the weight of the binder resin included in the toner.

Any customarily employed charge controlling agent may be suitably used for the purpose of the present invention. Examples of the charge controlling agent include a Nigrosine dye, a metal complex type dye, and a quaternary ammonium salt. These polarity controlling agents are used alone Or in combination. Especially preferred is the use of a metal complex of salicylic acid as the charge controlling agent. The metal of such a complex preferably has three or more valence capable of forming a hexa-coordinated complex. Such a metal complex can form a slightly-crosslinked structure by reacting with a functional group of a wax so that a toner having good hot-offset resistance as well as good charge properties can be produced. Specific examples of metals having three or more valence include Al, Fe, Cr, and Zr. The amount of the charge controlling agent in the toner is from 0.1 to 10% by weight, preferably from 1 to 5% by weight, based on the weight of the binder resin included in the toner.

The fluidity improving agent is an external additive attached to outer surfaces of the toner particles. Inorganic fine particles such as silica, titanium oxide, silicon carbide, aluminum oxide and barium titanate are suitably used. The use of a combination of silica and titanium oxide is particularly preferred for reasons of improved fluidity, developing efficiency and chargeability of the toner. The amount of the fluidity improving agent is from 0.1 to 5% by weight, preferably from 0.5 to 2% by weight, based on the weight of the toner.

The toner of the present invention may be a magnetic toner which includes a magnetic material. Suitable magnetic materials for use in the toner include iron oxides such as magnetite, hematite and ferrite; metals such as iron, cobalt and nickel, and their metal alloys or mixtures with aluminum, copper, lead, magnesium, tin, zinc, antimony, beryllium, bismuth, cadmium, calcium, manganese, selenium, titanium, tungsten, vanadium, and the like; and the like. Above all, magnetite is preferable because of its good magnetic properties. The average particle diameter of the magnetic material is preferably from 0.1 to 2 μm. The amount of the magnetic material is 15 to 200 parts by weight, preferably from 20 to 100 parts by weight, per 100 parts by weight of the binder resin included in the toner.

The toner of the present invention can be prepared by any conventionally-known method such as a pulverization method in which a kneaded mixture containing ingredients of the toner is solidified and ground.

As a device for kneading ingredients of the toner, the following kneaders can be appropriately employed: a batch-type two-roll mixer, Banburry's mixer, a continuous two-roll extruder such as a KTK type two-axle extruder manufactured by Kobe Steel, Ltd., a TEM type two-axle extruder manufactured by Toshiba Machine Co., Ltd., a two-axle extruder made by KCK Co., Ltd., a PCM type two-axle extruder manufactured by Ikegai Tekko Co., Ltd., a KEX type two-axle extruder manufactured by Kurimoto, Ltd., and a continuous one-axle kneader such as KO-KNEADER manufactured by Buss AG.

The ingredients may be suitably blended using a Henschel mixer or the like before kneading. It is possible to use a processed colorant obtained by, for example, kneading a colorant with a small amount of a resin for the purpose of obtaining uniform dispersion of the colorant.

The thus obtained kneaded mixture is cooled and ground. The grinding may be performed by a combination of a coarse pulverization with a hammer mill, Rotoplex (a grinder manufactured by Hosokawa Micron Co., Ltd.) or the like and succeeding fine pulverization with a jet air pulverizer or a mechanical pulverizer. When necessary depending upon the particle size distribution of the obtained toner, the toner will be adjusted to have a desired particle size distribution by an air classifier or the like.

The toner of the present invention may be also suitably prepared by a dispersing method in which an organic solvent solution or dispersion containing ingredients of the toner including a binder resin is dispersed in an aqueous medium with stirring to form toner particles which are subsequently separated and dried, or a suspension polymerization method in which an organic solvent solution or dispersion containing ingredients of the toner including a monomer or prepolymer of a binder resin is dispersed in an aqueous medium with stirring to polymerize the monomer or prepolymer and to form toner particles which are subsequently separated and dried.

The toner of the present invention preferably has a volume average particle diameter of 5 to 10 $\mu$m for reasons of improved image quality such as fine line reproducibility.

The volume average particle diameter herein is measured using Coulter counter TA-II (manufactured by Coulter Electronics Inc.) as follows.

0.1 to 5 Ml of a surfactant (preferably alkyl benzene sulfonate salt) is added as a dispersant to 100 to 150 ml of an electrolytic solution, which is an about 1% aqueous solution of NaCl prepared using a first-grade sodium chloride such as ISOTON-II (made by Coulter Scientific Japan Co.). 2 to 20 Mg of a sample is added to the aqueous solution. The electrolytic solution in which the sample is suspended is subjected to dispersion treatment for about 1 to 3 minutes using an ultrasonic disperser. The measuring apparatus measures the suspension for the volume and the number of the toner particles using an aperture having a diameter of 100 $\mu$m and calculates the volume distribution and the number distribution thereof. From the thus obtained distributions, the volume-average particle diameter (Dv) and the number-average particle diameter (Dp) of the toner particles can be obtained.

In the measurement, 13 channels, i.e., 2.00–2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m; 10.08–12.70 $\mu$m; 12.70–16.00 $\mu$m; 16.00–20.20 $\mu$m; 20.20–25.40 $\mu$m; 25.40–32.00 $\mu$m; and 32.00–40.30 $\mu$m (the upper limit not included), are used and particles having a diameter of not smaller than 2.00 $\mu$m and less than 40.30 $\mu$m are measured.

In the toner according to the present invention, the first and second polyester resins preferably form discrete domains from each other. Thus, one of the first and the second polyester resins forms dispersed domains, preferably uniformly finely dispersed domains, like islands, dispersed in a matrix, like a sea, of the other polyester resin. Generally, one of the polyester resins which is greater in amount than the other forms the matrix.

The formation of the discrete domain structure can be confirmed by transmission electron microscopy (TEM). Namely, it has been found that the colorant contained in the toner is present in the domains of the second polyester resin, while the domains of the first polyester resin are substantially free of the colorant.

The TEM analysis herein is performed as follows. A toner sample is cut to obtain a thin cut piece having a thickness of about 100 $\mu$m. This is dyed with ruthenium tetraoxide and observed by TEM (Transmission Electron Microscope H-9000 manufactured by Hitachi Ltd.) at a magnification of about $10^4$ with an acceleration voltage of 300 kV.

For reasons of improved low temperature fixation efficiency, it is also preferred that the toner have at least three, first through third endothermic peaks P1, P2 and P3 in a DSC curve thereof, wherein the first through third endothermic peaks P1, P2 and P3 have peak temperatures of 40 to 70° C. attributed to the second polyester resin, 70 to 90° C. attributed to the releasing agent and 90 to 130° C. attributed to the first polyester resin, respectively, as shown in FIG. 1.

Figure 2:
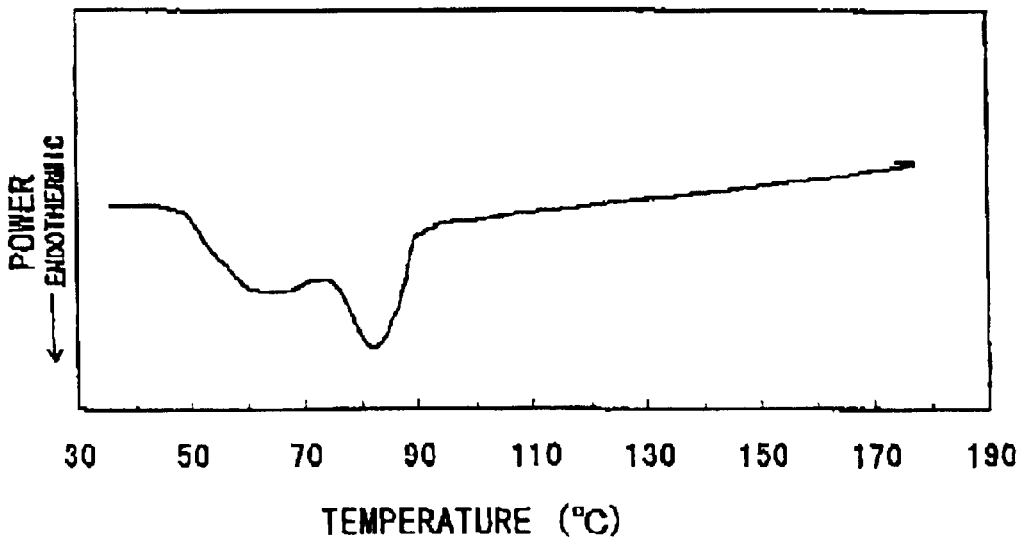
FIG. 2 is a DSC curve of a toner containing a binder resin which does not form discrete domains.

When the first and second polyester resins do not form discrete domains, the resulting toner gives a DSC curve as shown in FIG. 2.

It is also preferred that the toner show an X-ray diffraction pattern in which at least one peak is present in a region of 2θ of 20 to 25° for reasons of improved low temperature fixation efficiency. More preferably, the toner shows an X-ray diffraction pattern in which peaks are present in at least one of the four regions of, more preferably at least in each of the four regions of 2 θ of 19–20°, 21–22°, 23–25° and 29–31°. Such a toner contains a polyester resin (i.e. first polyester resin) whose crystal phase is not deteriorated by another polyester resin (i.e. second polyester resin) and, thus, whose domain or domains are separated from the domain or domains of the second polyester resin.

It is also preferred that the toner has a dielectric loss tangent in the range of $2.5\times10^{-3}$ to $10.0\times10^{-3}$, more preferably $2.5\times10^{-3}$ to $7.5\times10^{-3}$, for reasons of good chargeability and charge stability. Namely, the toner having the above dielectric loss tangent can be uniformly charged in a stable manner with a sharp distribution of the amount of the charges so that background stains, toner scattering and reduction of quality of images can be suitably prevented.

The dielectric loss tangent herein is measured as follows. First, sample toner formed into a tablet having a thickness of amount 2 mm and is set to an electrode (model SE-43 manufactured by Ando Denki Co., Ltd.). Using a dielectric-loss measuring device (model TR-10C, manufactured by Ando Electric Co., Ltd.), the dielectric loss tangent is measured with an applied AC current of 1 kHz.

The dielectric loss tangent has been found to represent an index showing the uniformity in dispersion of the colorant in the toner. Thus, when the dielectric loss tangent is in the above range, the colorant is uniformly dispersed in the toner to give the desired chargeability. Thus, in order to uniformly disperse the colorant, the kneading of ingredients of the toner, when prepared by the pulverization method, is preferably carried at a low temperature (but sufficient to melt the kneading mass) so that as high a shearing force as possible be evenly applied to the kneading mass. When the kneading temperature is high, it is difficult to uniformly disperse the colorant. In addition, the first and second polyesters may react so that the discrete domains are not smoothly formed. Furthermore, the molecular chain of the second polyester resin which has a relatively high molecular weight is apt to be broken.

The toner of the present invention can be used as a one component developer or as a two component developer in which the toner is mixed with a carrier.

Suitable materials for use as the carrier in the two component developer include known carrier materials such as magnetic powders, e.g., iron powders, ferrite powders, and nickel powders; beads such as glass beads; and the like. These materials may be coated with a resin. Suitable resins useful for coating these carrier materials include styrene-acrylic copolymers, silicone resins, maleic acid resins, fluorine-containing resins, polyester resins, epoxy resins, and the like. When styrene-acrylic copolymers are used, copolymers including styrene repeating unit in an amount of from 30 to 90% by weight are preferably used to obtain a carrier having good charge imparting properties and good service life. When carrier materials are coated with a resin coating liquid, the coating liquid may include additives such as tackifiers, hardeners, lubricants, electroconductive materials, charge controlling agents and the like.

The toner of the present invention, used as a one component developer or a two component developer, is generally delivered by itself to customers while being contained in a container. The toner container is set in an image forming apparatus such as copiers and printers by the customers. The container of the toner is not particularly limited. Any known containers such as bottle type containers and cartridge type containers can be used. In addition, the image forming apparatuses for which the toner of the present invention is used are also not particularly limited, and include known electrophotographic image forming apparatus such as copiers and printers.

Description will now be made of a method of forming an image with reference to FIG. 3 which is a schematic view illustrating a construction of an electrophotographic apparatus suitable for carrying out the method according to the present invention.

Figure 3:
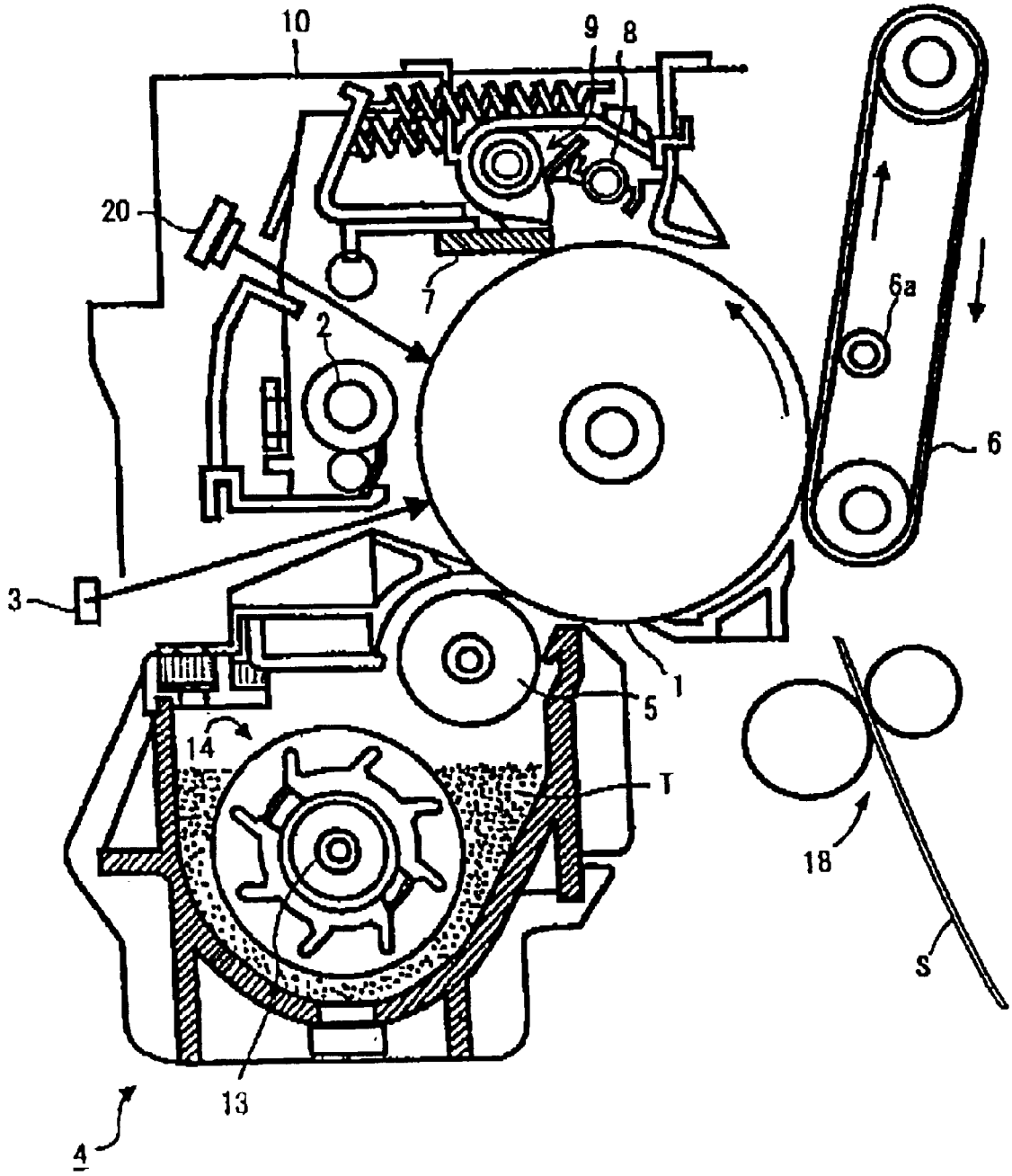
FIG. 3 is a cross-sectional view diagrammatically illustrating an image forming apparatus used to carry out an image forming method according to the present invention.

In the electrophotographic apparatus of FIG. 3, a cylindrically shaped photoconductor or photoreceptor 1 as an image bearing member is supported so as to rotate in the direction (counterclockwise) indicated by an arrow. Arranged around the photoreceptor 1, are a charging roller 2, an exposing device 3, a developing device 4, a transfer belt 6, a cleaning blade 7, a rotary blade 8, and a toner returning coil 9. The above-described elements except the transfer belt 6 are housed in a photoreceptor/cleaning unit 10.

The developing device 4 is housed in a case having an opening in which a developing sleeve 5 is rotatably supported and disposed opposite the surface of the photoreceptor 1. A paddle 14 is rotatably supported and disposed in the case at the position opposite the developing sleeve 5. In the paddle 14, a screw conveyor 13 is provided and supported such that the screw conveyor 13 rotates in the same direction as the paddle 14.

The thus constructed electrophotographic apparatus operates as follows. After the photoreceptor 1 is uniformly charged by the charging roller 2, the exposing device 3 exposes the surface of the photoreceptor 1 to form an electrostatic latent image on the photoreceptor 1. In the developing device 4, a two-component developer T is contained. The two-component developer T is a mixture of a carrier and a toner according to the present invention. When the developer T is agitated by the paddle 14, the toner is charged by friction. The developer T including the charged toner is attracted to the developing sleeve 5 and is conveyed as the developing sleeve 5 rotates. Subsequently, the toner on the developing sleeve 5 is transferred to the surface of the photoreceptor 1 at the position where the developing sleeve 5 faces the photoreceptor 1 so that the electrostatic latent image on the photoreceptor 1 is developed with toner to form a toner image on the photoreceptor 1. A voltage of opposite polarity to that of toner is applied to the transfer belt 6 through a bias roller **6*a* by a power source (not shown). A transfer sheet S is supplied from a feeding device (not shown) and is fed by resist rollers 18 to a transfer station (nip) between the photoreceptor 1 and the transfer belt 6, where the toner image on the photoreceptor 1 is transferred to the transfer sheet S by an electric field generated at the transfer station. Subsequently, the transfer sheet with the toner image is conveyed to a fixing device (not shown) by the transfer belt 6. The toner image is fused on the transfer sheet while passing through the fixing device. The toner which is not transferred to the transfer sheet and remains on the photoreceptor 1 is removed by the cleaning blade 7 and is then guided to the toner returning coil 9 by the rotary blade 8. Subsequently, the toner is returned to the developing device 4 as a recycled toner by the toner returning coil 9. Charges on the photoreceptor 1 cleaned by the cleaning blade 7 are removed by a lamp 20**.

The following examples will further illustrate the present invention. Parts are by weight.

Preparation of Polyesters A1 to A7:

Polyester Resins A1 to A7 used in the examples are prepared as follows.

The polycarboxylic acid material and polyol material as shown in Table 1 were placed in a four-necked round bottom flask equipped with a thermometer, a stirrer, a condenser and a nitrogen gas feed conduit and the mixture was reacted at 160° C. for 5 hours and then at 200° C. for 2 hours in a nitrogen gas atmosphere to obtain Polyester Resins A1 to A7.

TABLE 1

| Polyester Resin | Polycarboxylic acid material (mole %) | Polyol material (mole %) |
|---|---|---|
| A1 | Fumaric acid (95)<br>Trimellitic anhydride (5) | 1,4-Butanediol (95)<br>1,6-Hexanediol (5) |
| A2 | Terephtharic acid (65)<br>Dodecenylsuccinic anhydride (28)<br>Trimellitic anhydride (7) | Ethylene oxide (2.2 mole) adduct of bisphenol A (41.7)<br>Propylene oxide (2.2 mole) adduct of bisphenol A (58.3) |
| A3 | Fumaric acid (100) | 1,4-Butanediol (95)<br>Glycerin (5) |
| A4 | Fumaric acid (100) | 1,6-Hexanediol (100) |
| A5 | Fumaric acid (85)<br>Trimellitic anhydride (15) | 1,4-Butanediol (95)<br>1,6-Hexanediol (5) |
| A6 | Fumaric acid (95)<br>Trimellitic anhydride (5) | 1,4-Butanediol (100) |
| A7 | Fumaric acid (90)<br>Succinic acid (5)<br>Trimellitic anhydride (5) | 1,4-Butanediol (95)<br>1,6-Hexanediol (5) |

The physical properties of the thus obtained Polyester Resins A1 to A7 are summarized in Table 2 below. The solid $C^{13}$ NMR analysis revealed that Resins A1 and A3 to A7 contained the recurring unit of the formula (I) above.

The $C^{13}$ NMR analysis is carried out using FT-NMR (Fourier transform-nuclear magnetic resonance) apparatus (System JNM-α400 manufactured by Nippon Denshi K. K.) under the following conditions:

Standard; adamantane

Integration times; 8192 times

Pulse series: CPMAS

IRMOD: IRLEV.

Measurement frequency: 100.40 MHz

OBSET: 134500 Hz

POINT: 4096

PD: 7.0 sec
SPIN: 6088

Chem Draw Pro Ver. 4.5 is used as a software for the elucidation of the molecular structure.

The results of the $C^{13}$ NMR analysis were also confirmed by FTIR (Fourier transform infrared) transmission method (for comparison with the standard samples) and thermal decomposition gas chromatogram mass spectrum (GCMS, for analysis of decomposed products) conducted under the following conditions.

FTIR:
Measurement device: Nicolet Magna 850
Measurement range: 4000 to 400 $cm^{-1}$
Standard: KBr GCMS:
Measurement device: GC-17A and CR-4A (manufactured by Shimadzu Corporation)
Decomposition device: JHB-3S (manufactured by Japan Analysis Industry Co., Ltd.)
Decomposition: 590° C., 4 seconds
Column: DB-5 (manufactured by J & W Co.)
length: 30 m, inside diameter: 0.25 mm
film: 0.24 μm
Injection temperature: 320° C.
Carrier gas pressure: 90 kPa (retention time 2 min.)
increased to 150 kPa at a rate of 2 kPa/min.
Detector: FID

TABLE 2

| Polyester Resin | A1 | A2 | A3 | A4 | A5 | A6 | A7 |
|---|---|---|---|---|---|---|---|
| Crystalline *1 | yes | no | yes | yes | yes | yes | yes |
| Softening Point (° C.) *2 | 128 | 126 | 136 | 68 | 107 | 126 | 119 |
| Tg (° C.) *3 | 126 | 61 | 138 | 68 | 106 | 128 | 120 |
| Mw *4 | 6200 | 6610 | 9690 | 2052 | 8944 | 6290 | 6100 |
| Mn *5 | 1420 | 2010 | 1900 | 1080 | 1720 | 1390 | 1290 |
| Mw/Mn *6 | 4.4 | 3.3 | 5.1 | 1.9 | 5.2 | 4.5 | 4.7 |
| Acid Value (mgKOH/g) | 31.1 | 38.1 | 28.6 | 25.6 | 32.1 | 4.8 | 49.0 |
| Hydroxyl Value (mgKOH/g) | 29.6 | 37.6 | 22.1 | 30.4 | 27.7 | 3.9 | 51.0 |

*1 Whether or not Resins A1 to A7 are crystalline or not is determined by X-ray diffraction analysis. "Yes" means that diffraction peaks are present at 2θ of 19–20°, 21–22°, 23–25° and 29–31. "No" means that such peaks are not present.
*2 Softening point is $F_{1/2}$ temperature.
*3 "Tg" refers to glass transition point.
*4 "Mw" refers to a weight average molecular weight.
*5 "Mn" refers to a number average molecular weight.
*6 "Mw/Mn" refers to a ratio of the weight average molecular weight to the number average molecular weight.

Preparation of Polyesters B1 to B4:

Polyester Resins B1 to B4 used in the examples are prepared as follows.

The polycarboxylic acid material and polyol material as shown in Table 3 were placed in a four-necked round bottom flask equipped with a thermometer, a stirrer, a condenser and a nitrogen gas feed conduit and the mixture was heated to 200° C. Then, 0.05 g of dibutyltin oxide was added and the resulting mixture was reacted at 200° C. for 8 hours in a nitrogen gas atmosphere to obtain Polyester Resins B1 to B4.

TABLE 3

| Polyester Resin | Polycarboxylic acid material (mole %) | Polyol material (mole %) |
|---|---|---|
| B1 | Terephtharic acid (70) Dodecenylsuccinic anhydride (20) Trimellitic anhydride (10) | Ethylene oxide (2.2 mole) adduct of bisphenol A (41.7) Propylene oxide (2.2 mole) adduct of bisphenol A (58.3) |
| B2 | Terephtharic acid (70) Dodecenylsuccinic anhydride (15) Trimellitic anhydride (15) | Ethylene oxide (2.2 mole) adduct of bisphenol A (41.7) Propylene oxide (2.2 mole) adduct of bisphenol A (58.3) |
| B3 | Terephtharic acid (70) Dodecenylsuccinic anhydride (25) Trimellitic anhydride (5) | Ethylene oxide (2.2 mole) adduct of bisphenol A (41.7) Propylene oxide (2.2 mole) adduct of bisphenol A (58.3) |
| B4 | Fumaric acid (90) Trimellitic anhydride (10) | Ethylene oxide (2.2 mole) adduct of bisphenol A (41.7) Propylene oxide (2.2 mole) adduct of bisphenol A (58.3) |

The physical properties of the thus obtained Polyester Resins B1 to B4 are summarized in Table 4 below.

TABLE 4

| Polyester Resin | B1 | B2 | B3 | B4 |
|---|---|---|---|---|
| Softening Point (° C.) *1 | 152 | 170 | 129 | 149 |
| Tg (° C.) *1 | 61 | 71 | 49 | 59 |

*1 Softening point is $F_{1/2}$ temperature.
*2 "Tg" refers to glass transition point.

PREPARATION EXAMPLE 1

Toner Ingredients:

| | |
|---|---|
| First polyester resin: Polyester Resin A1 | 30 parts |
| Second polyester resin: Polyester Resin B1 | 70 parts |
| Wax: free fatty acid-removed carnauba wax (mp: 83° C.) | 5 parts |
| Colorant: carbon black (#44 manufactured by Mitsubishi Chemical Corporation) | 10 parts |

The above toner ingredients were fully mixed and agitated in a Henschel mixer and then kneaded in a two-axle extruder. After having been cooled, the kneaded mixture was pulverized and classified to obtain mother toner particles having a volume average diameter of 6.8 $\mu$m. The kneading was carried out as low a temperature as possible. Thus, the kneaded product in the outlet of the kneader had a temperature of 120° C. The mother toner particles were mixed 0.5% by weight of hydrophobic silica and 0.3% by weight of titanium oxide in a Henschel mixer, thereby obtaining a Toner No. 1.

PREPARATION EXAMPLE 2

Preparation Example 1 was repeated in the same manner as described except that Polyester A2 was substituted for Polyester A1 to obtain Toner No. 2.

PREPARATION EXAMPLE 3

Preparation Example 1 was repeated in the same manner as described except that Polyester A3 was substituted for Polyester A1 to obtain Toner No. 3.

PREPARATION EXAMPLE 4

Preparation Example 1 was repeated in the same manner as described except that Polyester A4 was substituted for Polyester A1 to obtain Toner No. 4.

PREPARATION EXAMPLE 5

Preparation Example 1 was repeated in the same manner as described except that Polyester A5 was substituted for Polyester A1 to obtain Toner No. 5.

PREPARATION EXAMPLE 6

Toner Ingredients;

| | |
|---|---|
| First polyester resin: Resin A1 | 60 parts |
| Second polyester resin: Resin B1 | 40 parts |
| Wax: free fatty acid-removed carnauba wax (mp: 83° C.) | 5 parts |
| Colorant: carbon black (#44 manufactured by Mitsubishi Chemical Corporation) | 10 parts |

Preparation Example 1 was repeated in the same manner as described except that the above ingredients were used to obtain Toner No. 6.

PREPARATION EXAMPLE 7

Toner Ingredients:

| | |
|---|---|
| First polyester resin: Resin A1 | 0.5 part |
| Second polyester resin: Resin B1 | 90.5 parts |
| Wax: free fatty acid-removed carnauba wax (mp: 83° C.) | 5 parts |
| Colorant: carbon black (#44 manufactured by Mitsubishi Chemical Corporation) | 10 parts |

Preparation Example 1 was repeated in the same manner as described except that the above ingredients were used to obtain Toner No. 7.

PREPARATION EXAMPLE 8

Preparation Example 1 was repeated in the same manner as described except that Polyester B2 was substituted for Polyester B1 to obtain Toner No. 8.

PREPARATION EXAMPLE 9

Preparation Example 1 was repeated in the same manner as described except that Polyester B3 was substituted for Polyester B1 to obtain Toner No. 9.

PREPARATION EXAMPLE 10

Preparation Example 1 was repeated in the same manner as described except that Polyester B4 was substituted for Polyester B1 to obtain Toner No. 10.

PREPARATION EXAMPLE 11

Preparation Example 1 was repeated in the same manner as described except that polyethylene wax having Tg of 110° C. was substituted for fatty acid-removed carnauba wax to obtain Toner No. 11.

PREPARATION EXAMPLE 12

Preparation Example 1 was repeated in the same manner as described except that polyethylene wax having Tg of 58° C. was substituted for fatty acid-removed carnauba wax to obtain Toner No. 11.

PREPARATION EXAMPLE 13

Preparation Example 1 was repeated in the same manner as described except that Polyester A6 was substituted for Polyester A1 to obtain Toner No. 13.

PREPARATION EXAMPLE 14

Preparation Example 1 was repeated in the same manner as described except that Polyester A7 was substituted for Polyester A1 to obtain Toner No. 14.

PREPARATION EXAMPLE 15

Preparation Example 1 was repeated in the same manner as described except that the kneading was carried out such that the kneaded product in the outlet of the kneader had a temperature of 160° C. to obtain Toner No. 15.

PREPARATION EXAMPLE 16

Preparation Example 1 was repeated in the same manner as described except that the kneading was carried out such that the kneaded product in the outlet of the kneader had a temperature of 200° C. to obtain Toner No. 16.

EXAMPLE 1–14 AND COMPARATIVE EXAMPLES 1 AND 2

Each of Toner Nos. 1–16 obtained in Preparation Examples 1–16 was measured for TEM, DSC and powder X-ray diffraction pattern to determine whether or not a discrete domain structure (by TEM), three, first through third endothermic peaks at peak temperatures in the ranges of 40 to 70° C., 70 to 90° C. and 90 to 130° C., respectively (by DSC) and at least one diffraction peak at 2θ of 20 to 25° region (by X-ray) are present. The results are shown in Table 5. In Table 5, "yes" means "present" and "no" means "not present".

TABLE 5

| Example | Toner No. | Discrete Domains | Endo-thermic Peaks | Diffrac-tion Peaks | Dielectric Loss Tangent |
|---|---|---|---|---|---|
| 1 | 1 | yes | yes | yes | $6.2 \times 10^{-3}$ |
| Comp. 1 | 2 | no | no | no | $5.8 \times 10^{-3}$ |
| 2 | 3 | yes | no | yes | $6.0 \times 10^{-3}$ |
| 3 | 4 | yes | no | yes | $6.3 \times 10^{-3}$ |
| 4 | 5 | yes | yes | yes | $6.8 \times 10^{-3}$ |
| 5 | 6 | yes | yes | yes | $9.0 \times 10^{-3}$ |
| 6 | 7 | yes | yes | yes | $5.4 \times 10^{-3}$ |
| 7 | 8 | yes | yes | yes | $5.8 \times 10^{-3}$ |
| 8 | 9 | yes | yes | yes | $6.1 \times 10^{-3}$ |
| 9 | 10 | yes | yes | yes | $5.9 \times 10^{-3}$ |
| 10 | 11 | yes | yes *1 | yes | $6.1 \times 10^{-3}$ |
| 11 | 12 | yes | yes *2 | yes | $6.0 \times 10^{-3}$ |
| 12 | 13 | yes | yes | yes | $5.4 \times 10^{-3}$ |
| 13 | 14 | yes | yes | yes | $5.8 \times 10^{-3}$ |
| 14 | 15 | yes | yes | yes | $11.6 \times 10^{-3}$ |
| Comp. 2 | 16 | no | no | no | $6.0 \times 10^{-3}$ |

*1 the second endothermic peak is present at peak temperature of 108° C.
*2 the second endothermic peak is present at peak temperature of 57° C.

Further, for the evaluation of easiness in preparation of the toners, a part of the kneaded mixture in each of the Preparation Examples 1–16 was cooled and coarsely pulverized to an average particle diameter of 1 mm or less. The coarsely pulverized particles were then finely ground using a pulverizer "Model IDS" manufactured by Nippon Pneumatic Mfg. Co., Ltd. under a given condition. The pulverizability of the toner was evaluated in terms of the amount of the toner processed per hour.

| | |
|---|---|
| A: (Excellent) | 1.5 kg or more |
| B: (Good) | less than 1.5 kg but not less than 0.8 kg |
| C: (Fair) | less than 0.8 kg but not less than 0.5 kg |
| D: (No Good) | less than 0.5 kg but not less than 0.2 kg |
| E: (Poor) | less than 0.2 kg |

The results of the evaluation are summarized in Table 6.

Each of Toners No. 1 through No. 16 was tested for the heat resistant preservability according to the method shown below. The results are summarized in Table 6.

The toner is packed in a glass container and the container placed in a thermostatic chamber at 50° C. for 24 hours. The toner is then cooled to 24° C. and is tested for penetration (mm) according JIS K2235 (1991). The larger the penetration, the better is the preservability.

| | |
|---|---|
| A: (Excellent) | penetrated completely |
| B: (Good) | 25 mm or more |
| C: (Fair) | no less than 20 mm but less than 25 mm |
| D: (No good) | no less than 15 mm but less than 20 mm |
| E: (poor) | Less than 15 mm |

Additionally, each of Toner Nos. 1–16 was processed into two-component developer by the method shown below and tested for low temperature fixation efficiency, resistance to hot offset and background stains according to the test methods shown below. The results are summarized in Table 6.

Preparation of Carrier:

450 Parts of a silicone resin (SR2400 manufactured by Toray Dow-Corning Silicone Inc.; non-volatile matter content: 50% by weight), 10 parts of aminosilane (SH6020 manufactured by Toray Dow-Corning Silicone Inc.) and 10 parts of carbon black were dispersed in 450 parts of toluene with stirring for 10 minutes to obtain a coating liquid. 5,000 Parts of carrier core (Cu—Zn ferrite particles; volume average diameter 45 μm) were coated with the above coating liquid using a coating apparatus provided with a bottom rotary disc and stirring blades and adapted to form a vortex of a fluidized bed. The coated particles were then heated at 250° C. for 2 hours in an electric oven to obtain a carrier having saturation magnetization of 65 emu/g at an applied magnetic field of 3 kOe, residual magnetization of 0 (zero) emu/g at an applied magnetic field of 3 kOe, a specific resistivity of $3.2 \times 10^8$ Ω·cm and a volume average particle diameter of 45 μm.

Preparation of Developer:

2.5 Parts of each of Toner Nos. 1–16 obtained in Preparation Examples 1–16 and 97.5 parts of the carrier obtained above were mixed and agitated in a tabler mixer to prepare a developer.

Fixation Efficiency:

The developer is set in a copying machined (Model MF 2200 manufactured by Ricoh Company, Ltd.) having a fixing unit modified to install a Teflon-coated roller as a fixing roller. Copies are produced using copy paper (Type 6200 manufactured by Ricoh Company, Ltd.) while changing the fixing temperature of the fixing roller to determine the cold offset temperature (i.e., a minimum fixing temperature below which cold offset occurs) and hot offset temperature (i.e., a maximum fixing temperature above which hot offset occurs), Thus, the low temperature fixation efficiency and hot offset resistance of the toner are evaluated. The minimum fixing temperature of conventional low temperature fixable toners is about 140 to 150° C. The fixing conditions for the evaluation of the low temperature fixation efficiency are as follows:

Paper feeding speed: 120 to 150 mm/sec
Pressure of fixing roller: 1.2 Kgf/cm$^2$
Nip width of the fixing area: 3 mm while the fixing conditions for the evaluation of the hot offset resistance are as follows:

Paper feeding speed: 50 mm/sec
Pressure of fixing roller: 2.0 Kgf/cm$^2$
Nip width of the fixing area: 4.5 mm The low temperature fixation efficiency is evaluated according to the following ratings:

A: the minimum fixing temperature is lower than 130° C.
B: the minimum fixing temperature is not lower than 130° C. but lower than 140° C.

C: the minimum fixing temperature is not lower than 140° C. but lower than 150° C.

D: the minimum fixing temperature is not lower than 150° C. but lower than 160° C.

E: the minimum fixing temperature is at least 160° C.

The hot offset resistance is evaluated according to the following ratings:

A: the maximum fixing temperature is at least 200° C.

B: the maximum fixing temperature is not lower than 190° C. but lower than 200° C.

C: the maximum fixing temperature is not lower than 180° C. but lower than 190° C.

D: the maximum fixing temperature is not lower than 170° C. but lower than 180° C.

E: the maximum fixing temperature is lower than 170° C.

Background Stains:

The developer is set in a copying machined (Model MF 2200 manufactured by Ricoh Company, Ltd.). 100,000 Copies are continuously produced at ambient temperature and humidity. Background stain in the non-image portion is observed with naked eyes and is evaluated according to the following ratings:

A: excellent

B: good

C: fair

D: no good but practically no problems

E: poor and cause problems

The results of the evaluation are summarized in Table 6.

TABLE 6

| Example | Toner No. | Pulverizability | Heat Resistant Preservability | Low temperature Fixation Efficiency | Resistance to hot offset | Background Stains |
|---|---|---|---|---|---|---|
| 1 | 1 | B | B | A | A | B |
| Comp. 1 | 2 | B | B | C | C | B |
| 2 | 3 | B | B | B | A | B |
| 3 | 4 | B | B | A | B | B |
| 4 | 5 | B | B | B | A | B |
| 5 | 6 | B | B | A | C | C |
| 6 | 7 | C | B | B | A | B |
| 7 | 8 | D | A | A | A | B |
| 8 | 9 | A | C | A | D | B |
| 9 | 10 | B | B | A | B | B |
| 10 | 11 | B | A | A | D | B |
| 11 | 12 | B | E | A | B | B |
| 12 | 13 | B | B | B | A | B |
| 13 | 14 | B | B | A | B | B |
| 14 | 15 | B | B | A | A | D |
| Comp. 2 | 16 | B | C | D | D | B |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The entire disclosure of Japanese Patent Application No. 2001-288776 filed on Sep. 21, 2001, including the specification, claims and drawing is hereby incorporated by reference herein.

What is claimed is:

1. A toner for developing electrostatic latent images, comprising a colorant, a releasing agent and a binder resin, wherein said binder resin comprises a first, crystalline polyester resin, and a second, amorphous polyester resin having a softening point higher than that of said first polyester resin and being incompatible with said first polyester resin, wherein the toner has a dielectric loss tangent in the range of $2.5\times10^{-3}$ to $10.0\times10^{-3}$.

2. A toner as claimed in claim 1, wherein said first polyester resin has a softening point in the range of 65 to 140° C. and a glass transition point in the range of 65 to 140° C. and comprising at least 60 mole % of a recurring unit represented by the following formula (I):

$$—O—CO—R—CO—O—(CH_2)— \quad (I)$$

wherein R represents a divalent hydrocarbyl group having 2–20 carbon atoms and n is an integer of 2 to 35.

3. A toner as claimed in claim 2, wherein R of the formula (I) is a divalent unsaturated aliphatic group having at least one carbon-carbon double bond.

4. A toner as claimed in claim 3, wherein said divalent unsaturated aliphatic group is represented by the formula $—CR^1{=}CR^2—$ wherein $R^1$ and $R^2$ independently represent a hydrogen atom or a hydrocarbyl group having 1–20 carbon atoms.

5. A toner as claimed in claim 1, wherein the dielectric loss tangent is in the range of $2.5\times10^{-3}$ to $7.5\times10^{-3}$.

6. A toner as claimed in claim 1, and having at least three, first through third endothermic peaks in a DSC curve thereof, wherein said first through third endothermic peaks have peak temperatures of 40 to 70° C., 70 to 90° C. and 90 to 130° C., respectively.

7. A toner as claimed in claim 1, and showing an X-ray diffraction pattern in which at least one peak is present in a region of 2θ of 20 to 25°.

8. A toner as claimed in claim 1, and showing an X-ray diffraction pattern in which peaks are present in at least four regions of 2θ of 19–20°, 21–22°, 23–25° and 29–31°.

9. A toner as claimed in claim 1, wherein said first polyester resin is present in an amount of 1 to 50% by weight based on the weight of said binder resin.

10. A toner as claimed in claim 1, wherein said first polyester resin is obtained from a polycarboxylic acid material comprising at least one of maleic acid and fumaric acid with a polyhydric alcohol material comprising at least one of 1,4-butanediol and 1,6-hexanediol.

11. A toner as claimed in claim 10, wherein said polycarboxylic acid material additionally comprises at least one of succinic acid and trimellitic anhydride.

12. A toner as claimed in claim 1, wherein said second polyester resin has a softening point in the range of 120 to 160° C. and a glass transition point in the range of 40 to 70° C.

13. A toner as claimed in claim 1, wherein said releasing agent has a glass transition point in the range of 70 to 90° C.

14. A toner as claimed in claim 1, wherein said first polyester resin has an acid value of 20 to 45 mg KOH/g.

15. A toner as claimed in claim 1, wherein said first polyester resin has a hydroxyl value of 5 to 50 mg KOH/g.

16. A toner as claimed in claim 1, wherein said first polyester resin has o-dichlorobenzene solubles having a molecular weight characteristics according to gel permeation chromatography wherein the weight average molecular weight Mw ranges from 5,500 to 6,500, the number average molecular weight Mn ranges from 1,300 to 1,500 and the ratio Mw/Mn of the weight average molecular weight Mw to the number average molecular weight Mn ranges from 2 to 5.

17. A toner as claimed in claim 1, wherein said releasing agent is selected from the group consisting of free fatty acid-removed carnauba wax, montan wax and oxidized rice wax.

18. A toner as claimed in claim 1, wherein said second polyester resin is obtained from a polyhydric alcohol material comprising a propylene oxide adduct of bisphenol A and an ethylene oxide adduct of bisphenol A and a polycarboxylic acid material comprising terephthalic acid, dodecenylsuccinic anhydride, fumaric acid and trimellitic anhydride.

19. A toner as claimed in claim 1, wherein said first polyester resin shows an X-ray diffraction pattern in which at least one peak is present in a region of 2θ of 20 to 25°.

20. A toner as claimed in claim 1, wherein said first polyester resin shows an X-ray diffraction pattern in which peaks are present in at least four regions of 2° of 19–20°, 21–22°, 23–25° and 29–31°.

21. A toner as claimed in claim 1, wherein said first and second polyester resins form discrete domains from each other.

22. A toner as claimed in claim 21, wherein said first polyester resin forms a matrix in which said second polyester resin is dispersed.

23. A toner as claimed in claim 21, wherein said second polyester resin forms a matrix in which said first polyester resin is dispersed.

24. A toner as claimed in claim 21, wherein said colorant is contained in the domains of said second polyester resin, while the domains of said first polyester resin are substantially free of said colorant.

25. A toner cartridge containing a toner according to claim 1.

26. An image forming method, comprising developing an electrostatic latent image on a latent image-bearing member with a toner according to claim 1.

27. A process cartridge freely detachable from an image forming apparatus, comprising a photoconductor, and at least one means selected from the group consisting of a charger, image exposure means, developing means comprising a toner according to claim 1, image transfer means, and cleaning means.

28. An image forming apparatus comprising a developing unit for developing an electrostatic latent image on an latent image-bearing member with a toner according to claim 1.

* * * * *

UNITED STATES PATENT AND TRADEMARK OFFICE

CERTIFICATE OF CORRECTION

PATENT NO. : 6,821,698 B2 
DATED : November 23, 2004
INVENTOR(S) : Toyoshi Sawada et al.

It is certified that error appears in the above-identified patent and that said Letters Patent is hereby corrected as shown below:

Title page,
Item [73], Assignee, "Ricoh Company, LTD," should read -- Ricoh Company, Ltd., --

Signed and Sealed this

Twenty-ninth Day of March, 2005

JON W. DUDAS
*Director of the United States Patent and Trademark Office*